US010760020B2

(12) United States Patent
Kashio et al.

(10) Patent No.: US 10,760,020 B2
(45) Date of Patent: Sep. 1, 2020

(54) HEAVY FUEL OIL C COMPOSITION

(71) Applicant: Showa Shell Sekiyu K. K., Tokyo (JP)

(72) Inventors: Tsuyoshi Kashio, Tokyo (JP); Yasuyuki Komatsu, Tokyo (JP)

(73) Assignee: IDEMITSU KOSAN CO., LTD, Tokyo (JP)

( * ) Notice: Subject to any disclaimer, the term of this patent is extended or adjusted under 35 U.S.C. 154(b) by 0 days.

(21) Appl. No.: 16/465,695

(22) PCT Filed: Nov. 28, 2017

(86) PCT No.: PCT/JP2017/042560
§ 371 (c)(1),
(2) Date: May 31, 2019

(87) PCT Pub. No.: WO2018/101244
PCT Pub. Date: Jun. 7, 2018

(65) Prior Publication Data

US 2019/0300806 A1 Oct. 3, 2019

(30) Foreign Application Priority Data

Dec. 1, 2016 (JP) ..... 2016-234525

(51) Int. Cl.
*C10L 1/08* (2006.01)
*C10L 1/04* (2006.01)

(52) U.S. Cl.
CPC ..... *C10L 1/08* (2013.01); *C10L 1/04* (2013.01); *C10L 2200/0446* (2013.01); *C10L 2270/026* (2013.01)

(58) Field of Classification Search
None
See application file for complete search history.

(56) References Cited

U.S. PATENT DOCUMENTS 4,526,586 A * 7/1985 Schwab ..... C10L 1/328 44/302
4,557,734 A * 12/1985 Schwab ..... C10L 1/32 44/302
2007/0135669 A1* 6/2007 Koivusalmi ..... C11C 3/123 585/331
2012/0167451 A1* 7/2012 Festuccia ..... C10L 1/02 44/307
2012/0246999 A1 10/2012 Stern et al.
2013/0144098 A1* 6/2013 Pansare ..... C10L 1/04 585/310
2015/0072298 A1* 3/2015 Kohler ..... C10L 1/08 432/29

FOREIGN PATENT DOCUMENTS

JP 2009-096855 A 5/2009
JP 2011-046892 A 3/2011
JP 2014-051591 A 2/2014
JP 2015-189891 A 11/2015

OTHER PUBLICATIONS

International Search Report for International Application No. PCT/JP2017/042560, dated Feb. 27, 2018.
"Low-sulphur fuels explained," Insight, Gard News 209, Jan. 16, 2013.
International Preliminary Report on Patentability for PCT/JP2017/042560, dated Jun. 4, 2019.

* cited by examiner

*Primary Examiner* — Tam M Nguyen
(74) *Attorney, Agent, or Firm* — Pearne & Gordon LLP

(57) ABSTRACT

[Problem to be Solved] It is an object to provide a C-type heavy fuel oil composition that is excellent in lubricity, has excellent low-temperature fluidity, ignitability and heating value and is excellent in fuel sealing properties even if the sulfur content is low. [Solution] A C-type heavy fuel oil composition includes a sulfur content of 0.100 mass % or lower, and 5 to 400 mass ppm on a sulfur basis of a sulfur compound having a boiling point of no lower than a boiling point of dibenzothiophene. The composition has a density (15° C.) of 0.8700 to 0.9400 g/cm$^3$, a kinematic viscosity (50° C.) of 3.500 to 25.000 mm$^2$/s, a pour point of no higher than 25.0° C., a flash point of at least 70.0° C., and a gross heating value of at least 39,000 J/L.

3 Claims, No Drawings

HEAVY FUEL OIL C COMPOSITION

TECHNICAL FIELD

The present invention relates to a C-type heavy fuel oil composition used for external combustion such as boilers and diesel engines such as ships.

BACKGROUND ART

Dealing with environmental concerns has conventionally been focused on emission from automobiles or factories because an amount of the emission from them is large. In recent years, however, improving an amount of emission from shipping vessels has been desired as well in spite of good energy efficiency and relatively a small amount of emission. In order to reduce an amount of sulfur oxide (SOx) and black smoke emitted mainly from ships, a sulfur content in marine fuels is being regulated (refer to Non Patent Literatures 1 and 2).

The sulfur oxide and particulate matter are attributable to sulfur in fuels (Non Patent Literature 1). Thus, using fuels including 0.5 mass % or less, currently 3.5 mass %, of the sulfur content for the ships sailing in the general sea area is obligated in 2020 or 2025. Additionally, using fuels including 0.1 mass % or lower of the sulfur content for the ships sailing in the sea and in the gulf coast near California and Europe is obligated.

A C-type heavy fuel oil composition, which is widely used as marine fuels, can be subject to the above regulation of the sulfur content. However, the C-type heavy fuel oil composition is required to satisfy necessary performance in terms of not only the sulfur content but also other properties, such as ignitability, combustibility and low-temperature fluidity. Accordingly, various techniques therefor have been proposed until now.

For example, in Patent Literature 1 (Japanese Patent Laid-Open No. 2014-51591), a C-type heavy fuel oil composition having an ignitability index I, as derived from a specific equation, of not less than 0 and less than 15 is proposed.

CITATION LIST

Patent Literature

Patent Literature 1: Japanese Patent Laid-Open No. 2014-51591

Non Patent Literature

Non Patent Literature 1: Ministry of Land, Infrastructure, Transport and Tourism, Maritime Bureau, "Maritime Report 2014, Fune ga ugoku. Sekai ga ugoku. (in Japanese; The ship moves. The world moves.)", Part 1: Important issues of maritime administration, Chapter 9: Efforts to environmental problems Non Patent Literature 2: Low-sulphur fuels explained (Japanese-language version), Gard News 209 February/April 2013, pp. 4-5

SUMMARY OF INVENTION

Technical Problem

However, in the conventional technique relating to the C-type heavy fuel oil composition, the sulfur content is not supposed to excessively decrease as long as it satisfies a prescribed standard (e.g., 0.5 mass % or less of JIS K 2205), and thus the sulfur content exceed 0.1 mass %. On that account, the issue that may occur in the C-type heavy fuel oil composition having the low sulfur content may not be solved by the conventional technique. Specifically, as the decrease of the sulfur content, lubricity, low-temperature fluidity, ignitability and heating value decrease. Additionally, an issue that oozing with fuels from a sealing material in a fuel supply system in the range from a fuel tank to an engine inlet of a ship is concerned.

Accordingly, it is an object of the present invention to provide a C-type heavy fuel oil composition that is excellent in lubricity, has excellent low-temperature fluidity, ignitability and heating value and is excellent in fuel sealing properties even if the sulfur content is low.

Solution to Problem

In order to achieve the above object, the present inventors have earnestly studied, and as a result, they have found that, by predetermined properties, particularly by a predetermined content on a sulfur basis of a sulfur compound having a boiling point of no lower than a boiling point of dibenzothiophene, a C-type heavy fuel oil composition that is excellent in lubricity, has excellent low-temperature fluidity, ignitability and heating value and is excellent in fuel sealing properties even if the sulfur content is low can be obtained. One aspect of the present invention is a C-type heavy fuel oil composition including a sulfur content of 0.100 mass % or lower, and 5 to 400 mass ppm on a sulfur basis of a sulfur compound having a boiling point of no lower than a boiling point of dibenzothiophene. The C-type heavy fuel oil composition has a density (15° C.) of 0.8700 to 0.9400 g/cm$^3$, a kinematic viscosity (50° C.) of 3.500 to 25.000 mm$^2$/s, a pour point of no higher than 25.0° C., a flash point of at least 70.0° C., and a gross heating value of at least 39,000 J/L.

Advantageous Effects of Invention

As described above, according to the embodiment of the present invention, a C-type heavy fuel oil composition that is excellent in lubricity, has excellent low-temperature fluidity, ignitability and heating value and is excellent in fuel sealing properties even if the sulfur content is low can be provided.

DESCRIPTION OF EMBODIMENTS

The C-type heavy fuel oil composition according to the present invention includes the sulfur content of 0.100 mass % or lower, preferably 0.010 to 0.100 mass %. The sulfur content is one of environmental pollution sources. An excessive sulfur content causes an increase of emission of sulfur oxide and particulates in an exhaust gas. Accordingly, the sulfur content is preferably lower, but an excessively low sulfur content generally decreases lubricity.

The sulfur content includes a sulfur compound having a boiling point of no lower than a boiling point of dibenzothiophene. Examples of the sulfur compound having a boiling point of no lower than a boiling point of dibenzothiophene include dibenzothiophene group, such as dibenzothiophene, 4-methyldibenzothiophene and 4,6-dimethyldibenzothiophene, and most of such sulfur compound is the dibenzothiophene group. An amount of the sulfur compound having a boiling point of no lower than a boiling point of dibenzothiophene is 5 to 400 mass ppm, preferably 50 to 400 mass ppm, more preferably 100 to 400 mass ppm, still more preferably 200 to 400 mass ppm, particularly preferably 200 to 350 mass ppm on a sulfur basis based on the C-type heavy fuel oil composition according to the present invention. By including a predetermined amount of the sulfur compound having a boiling point of no lower than a boiling point of dibenzothiophene in the C-type heavy fuel oil composition, lubricity can be improved even if the sulfur content is low. If the amount of the sulfur compound is too large, the possibility of oozing with fuels increases because sealing properties of the fuel supply system deteriorate.

The C-type heavy fuel oil composition according to the present invention preferably includes a nitrogen content of 0.005 to 0.08 mass %, more preferably 0.02 to 0.08 mass %, still more preferably 0.04 to 0.08 mass %. If the nitrogen content is small, lubricity may deteriorate. If the nitrogen content is large, an amount of nitrogen oxide may increase during combustion.

The C-type heavy fuel oil composition according to the present invention preferably includes 35.0 to 70.0 mass % of saturated hydrocarbons. A small content of the saturated hydrocarbons may cause deterioration of startability of engines. A large content of the saturated hydrocarbons may become worse of filterability.

The C-type heavy fuel oil composition according to the present invention preferably includes aromatics. Examples of the aromatics include monocyclic aromatics such as benzene having an alkyl group or a naphthene ring, bicyclic aromatics such as naphthalene having an alkyl group or a naphthene ring, and tricyclic aromatics such as phenanthrene or anthracene having an alkyl group or a naphthene ring. The aromatics are included in a proportion of preferably at least 25.0 mass %, more preferably at least 30.0 mass %, still more preferably at least 40.0 mass % in C-type heavy fuel oil composition. A larger content of aromatics is preferable in view of the lubricity and the filterability. However, an excessive content of the aromatics may cause deterioration of startability of engines due to a decrease of cetane index so that the aromatics are preferably included in a proportion of no more than 70.0 mass %.

The C-type heavy fuel oil composition according to the present invention preferably includes resins. From the viewpoints of sludge suppression during storage, and combustibility, the resins are included in an amount of preferably 0.2 to 0.6 mass %, more preferably 0.3 to 0.6 mass % in the C-type heavy fuel oil composition.

Asphaltenes are included in an amount of preferably not more than 0.4 mass %, more preferably not more than 0.2 mass % in the C-type heavy fuel oil composition, from the viewpoints of sludge suppression during storage, and combustibility.

A carbon residue is included in an amount of preferably no more than 0.05 mass %, more preferably no more than 0.04 mass % in the C-type heavy fuel oil composition according to the present invention. If the amount of the carbon residue is large, filterability and combustibility deteriorate.

A density (15° C.) of the C-type heavy fuel oil composition according to the present invention is 0.8700 to 0.9400 g/cm$^3$, preferably 0.8700 to 0.9300 g/cm$^3$, more preferably 0.9000 to 0.9300 g/cm$^3$, still more preferably 0.9100 to 0.9200 g/cm$^3$. If the density is low, the fuel economy may deteriorate. If the density is high, black smoke in the exhaust gas may increase, or the ignitability may deteriorate.

A kinematic viscosity (50° C.) of the C-type heavy fuel oil composition according to the present invention is 3.500 to 25.000 mm$^2$/s, preferably 4.000 to 7.000 mm$^2$/s, more preferably 5.000 to 7.000 mm$^2$/s, still more preferably 6.000 to 7.000 mm$^2$/s. If the kinematic viscosity at 50° C. is low, the lubrication performance may deteriorate. If the kinematic viscosity is high, fuel atomization in a combustor chamber may deteriorate, and the exhaust gas properties may also deteriorate.

A pour point of the C-type heavy fuel oil composition according to the present invention is no higher than 25.0° C., preferably no higher than 22.5° C. When the C-type heavy fuel oil composition is used as, for example, a marine fuel, a fuel supply line is generally heated in order to ensure fluidity of the fuel. Accordingly, a high pour point may cause an issue in the fuel transfer to an engine because a wax is clogged by insufficient heating.

A CCAI (Calculated Carbon Aromatic Index) of the C-type heavy fuel oil composition according to the present invention is preferably no more than 870, more preferably no more than 860, still more preferably no more than 850. An excessively high CCAI may cause an issue when an engine starts because ignitability deteriorates. An excessively low CCAI may cause an increase of an amount of unburnt hydrocarbon in the exhaust gas, and hence, the CCAI is preferably at least 760.

The flash point of the C-type heavy fuel oil composition according to the present invention is at least 70.0° C., preferably at least 90.0° C. from the viewpoints of safety and storage.

The gross heating value of the C-type heavy fuel oil composition according to the present invention is at least 39,000 J/L, preferably at least 40,000 J/L from the viewpoint of fuel economy.

The HFRR of the C-type heavy fuel oil composition according to the present invention based on ISO 12156-1 (of methods defined in Gas oil-testing method for lubricity, HFRR test is carried out at the load of 1000 gf in consideration of use in a marine fuel injection pump and abrasion of an injection pump in line with C-type heavy fuel oil specification, thereby measuring a diameter of a flattening of a fixed steel ball, and lubrication performance is evaluated) is preferably no more than 500 μm, more preferably no more than 470 μm, still more preferably no more than 450 μm, particularly preferably no more than 400 μm.

In a rubber swelling test (test in accordance with JIS K 6258 in which the rubber material is NBR, the temperature is 70° C., and the period of time is one week) using the C-type heavy fuel oil composition according to the present invention, it is preferable that the change in hardness be −19 to 15, the strength change ratio be −50 to 50%, the elongation change ratio be −50 to 20%, the volume change ratio be −60 to 60%, and the thickness change ratio be −20 to 20%.

The C-type heavy fuel oil composition according to the present invention can be prepared by blending one or more gas oil components and a residual oil in such a manner that the resulting mixture has specific properties defined. The gas oil components are obtained by subjecting crude oil to distillation and desulfurization and/or cracking treatments. The C-type heavy fuel oil composition may include an indirect desulfurization residual oil. In the C-type heavy fuel oil composition according to the present invention, the indirect desulfurization residual oil is included preferably in an amount of not less than 10 vol %, more preferably 10 to 95 vol %, still more preferably 30 to 95 vol %, particularly preferably 40 to 60 vol %. However, if the amount of the indirect desulfurization residual oil is too large, low-temperature fluidity may deteriorate. If the amount of the indirect desulfurization residual is too small, combustibility and lubricity may deteriorate.

The indirect desulfurization residual oil is a residue obtained by as follows: firstly, desulfurizing a heavy portion of a fraction whose boiling point range indicates gas oil, the fraction being obtained by separating from crude oil, and a reminder obtained by separating a fraction whose boiling point range indicates asphalt from the crude oil, concretely, desulfurizing a fraction of 330° C. to 550° C. separated from the crude oil by distillation; and secondly, removing a fraction lighter than that having a boiling point of 330° C. by distillation treatment. For example, a heavy gas oil fraction of 330° C. to 360° C. distilled by an atmospheric distillation unit and a fraction having a boiling point in the range of about 330° C. to 550° C. obtained by distilling a residue of atmospheric distillation by a vacuum distillation unit are subjected to desulfurization treatment solely or as a mixture, and then a fraction lighter than that having a boiling point of 330° C. is removed by distillation treatment to obtain the residue.

The indirect desulfurization residual oil includes a sulfur content of no more than 0.100 mass %, preferably no more than 0.090 mass % and a carbon residue content of no more than 0.1 mass %. The indirect desulfurization residual oil has a density (15° C.) of 0.8700 to 0.9100 g/cm$^3$, preferably 0.8800 to 0.9000 g/cm$^3$ and a kinematic viscosity (50° C.) of 10.000 to 25.000 mm$^2$/s.

In the C-type heavy fuel oil composition according to the present invention, a cracked gas oil may be blended. Examples of the cracked gas oils include gas oil fractions distilled in the upgrading process for a heavy fuel oil, such as a direct desulfurization gas oil obtained from a direct desulfurization unit, an indirect desulfurization gas oil obtained from an indirect desulfurization unit, and a catalytically cracked gas oil obtained from a fluid catalytic cracker. In the C-type heavy fuel oil composition according to the present invention, the cracked gas oil is preferably included in a proportion of 5 to 70 vol %. An excessively large amount of the cracked gas oil may cause deterioration of lubricity. An excessively small amount of the cracked gas oil may cause deterioration of low-temperature fluidity or a decrease of the heating value.

In general, a C-type heavy fuel oil composition is produced by blending a plurality of components and additives such as a low-temperature fluidity improver. In the C-type heavy fuel oil composition according to the present invention, additives may be blended, but when the components and the additives are blended, it is preferable that a lubricity improver not be included in the components.

It is preferable to use the C-type heavy fuel oil composition according to the present invention as a marine fuel.

EXAMPLES

Examples 1 to 4, Comparative Examples 1 and 2

The components described in table 1 were mixed in the volume ratios described in table 2 to obtain C-type heavy fuel oil compositions according to Examples 1 to 4 and Comparative Examples 1 and 2. The properties, etc. indicated in tables 1 to 3 were measured in the following manner.

Density (15° C.):

Measured in accordance with JIS K 2249 "Crude petroleum and petroleum products-Determination of density and petroleum measurement tables based on a reference temperature (15 centigrade degrees)". Flash point (° C.):

Measured in accordance with JIS K 2265-3 "Determination of flash point-Part 3: Pensky-Martens closed cup method".

Carbon Residue:

Measured in accordance with JIS K 2270 "Crude petroleum and petroleum products-Determination of carbon residue".

Kinematic Viscosity (30° C.), Kinematic Viscosity (50° C.):

Measured in accordance with JIS K 2283 "Crude petroleum and petroleum products-Determination of kinematic viscosity and calculation of viscosity index from kinematic viscosity".

CCAI:

CCAI is an index of a content of aromatics and ignitability. The index is calculated simply by the following equation using a density and a kinematic viscosity of a heavy fuel oil:

$$CCAI = D - 140.7 \log \{\log(V + 0.85)\} - 80.6,$$

where D represents a density (kg/m$^3$ at 15° C.), and V represents a kinematic viscosity (mm$^2$/s at 50° C.).

Pour Point (° C.):

Measured in accordance with JIS K 2269 "Testing Methods for Pour Point and Cloud Point of Crude Oil and Petroleum Products".

Saturated Hydrocarbons, Aromatics, Resins, Asphaltenes:

Measured in accordance with the JPI-5S-70 method "Composition analysis testing method due to TLC/FID method".

Nitrogen Content:

Measured in accordance with Chemiluminescence method of JIS K 2609 "Crude petroleum and petroleum products-Determination of nitrogen content".

Sulfur Content:

Measured in accordance with JIS K 2541-4 "Crude oil and petroleum products-Determination of sulfur content Part 4: Energy-dispersive X-ray fluorescence method".

A Content on a Sulfur Basis of Sulfur Compound Having Boiling Point of No Lower than Boiling Point of Dibenzothiophene:

Measured by a gas chromatograph method using a gas chromatograph, which is manufactured by Agilent, equipped with a sulfur chemiluminescence detector. A column of J&W DB-Sulfur SCD was used. A solution in which dibenzothiophene was dissolved in hexane was measured, and a position of a peak was determined as a retention time. Using dibutyl sulfide as a standard substance, a calibration curve was prepared. Next, a sample was measured, and the total area of peaks positioned after the retention time of dibenzothiophene, the peaks including the peak of dibenzothiophene, was determined from the calibration curve of dibutyl sulfide to determine a content on a sulfur basis of the sulfur compound having a boiling point of no lower than a boiling point of dibenzothiophene in the C-type heavy fuel oil composition. The gas chromatograph measurement conditions are as follows: the temperature was maintained at 35° C. for 3 minutes, raised up to 150° C. at 5° C./min, thereafter raised up to 270° C. at 10° C./min, and maintained for 22 minutes.

HFRR:

Of the methods defined in ISO 12156-1 Gas oil-testing method for lubricity, HFRR test was carried out at the load to 1000 gf, and the resulting diameter of a flattening of a fixed steel ball was used as an index of lubrication performance.

<Test Conditions>

Test ball: bearing steel (SUJ-2)

Load (P): 1000 gf

Frequency: 50 Hz

Stroke: 1000 μm

Testing time: 75 minutes

Temperature: 60° C.

Measuring method: A test sample was placed in a testing bath, and the temperature of the sample was maintained at 60° C. A steel test ball was mounted to a steel test ball mounting set in a vertical direction, and the test ball was pressed by a testing disc set in a horizontal direction at 1.96 mN load. In a state where the steel test ball was completely submerged in the testing bath, the steel test ball was caused to rub against the testing disk with reciprocating motion (vibrated) at a frequency of 50 Hz. After completion of the test, a diameter (μm) of a flattening of the mounted steel ball was measured.

Gross Heating Value:

Calculated in accordance with JIS K 2279 "Crude petroleum and petroleum products-Determination and estimation of heat of combustion". As a result of measurement, ash content and water content necessary for the calculation were extremely low, and hence, both were deemed to 0 mass % to calculate.

Rubber Swelling Test:

Measured in accordance with JIS K 6258. NBR was used as the rubber material. The temperature was set at 70° C. The period of time was one week.

TABLE 1

| | | Residual oil *1 | Cracked gas oil | Component A | Component B |
|---|---|---|---|---|---|
| Density (15° C.) | g/cm$^3$ | 0.8920 | 0.9528 | 0.8426 | 0.8660 |
| Flash point | ° C. | 178.5 | 86.0 | 82.5 | 86.5 |
| Kinematic viscosity (30° C.) | mm$^2$/s | — | 3.638 | 4.383 | 4.522 |
| Kinematic viscosity (50° C.) | mm$^2$/s | 19.590 | 2.350 | 2.863 | 2.899 |
| Pour point | ° C. | 25.0 | −20.0 | −2.5 | −5.0 |
| Iatroscan | | | | | |
| Saturated hydrocarbons | mass % | 55.7 | 16.6 | 74.4 | 47.3 |
| Aromatics | mass % | 44.0 | 82.5 | 25.4 | 52.3 |
| Resins | mass % | 0.3 | 0.8 | 0.2 | 0.3 |
| Asphaltenes | mass % | 0.0 | 0.1 | 0.0 | 0.1 |
| Sulfur content | mass % | 0.085 | 0.087 | <0.01 | 0.056 |
| Carbon residue | mass % | <0.01 | — | <0.01 | — |

—: unmeasurable or unmeasured

*1: Indirect desulfurization residual oil

TABLE 2

| | Comparative Examples | | | | Examples | |
|---|---|---|---|---|---|---|
| | 1 | 2 | 3 | 4 | 1 | 2 |
| Residual oil *1 | 100 | 60 | 40 | 40 | | 20 |
| Cracked gas oil | | 40 | 60 | | | 80 |
| Component A | | | | | 100 | |
| Component B | | | | 60 | | |

*1: Indirect desulfurization residual oil

TABLE 3

| | | Examples | | | | Comparative Examples | |
|---|---|---|---|---|---|---|---|
| | Unit | 1 | 2 | 3 | 4 | 1 | 2 |
| Density (15° C.) | g/cm$^3$ | 0.8920 | 0.9156 | 0.9277 | 0.8747 | 0.8426 | 0.9397 |
| Flash point | ° C. | 178.5 | 103.5 | 97.5 | 95.5 | 82.5 | 91.5 |
| Kinematic viscosity (50° C.) | mm$^2$/s | 19.590 | 6.933 | 4.607 | 5.606 | 2.863 | 3.192 |
| Carbon residue | mass % | <0.01 | <0.01 | 0.02 | 0.04 | <0.01 | <0.01 |
| Nitrogen content | mass % | 0.03 | 0.05 | 0.06 | 0.02 | <1 ppm | 0.06 |
| Iatroscan | | | | | | | |
| Saturated hydrocarbons | mass % | 55.7 | 46.0 | 38.1 | 61.7 | 74.4 | 25.7 |
| Aromatics | mass % | 44.0 | 53.5 | 61.4 | 37.8 | 25.4 | 73.7 |
| Resins | mass % | 0.3 | 0.5 | 0.5 | 0.4 | 0.2 | 0.5 |
| Asphaltenes | mass % | 0.0 | 0.0 | 0.0 | 0.1 | 0.0 | 0.1 |
| Sulfur content | mass % | 0.085 | 0.086 | 0.086 | 0.068 | <0.01 | 0.089 |
| Sulfur *2 | mass ppm | 8 | 239 | 355 | 60 | 0 | 470 |
| Pour point | ° C. | 25.0 | 17.5 | 7.5 | 10.0 | −2.5 | −5.0 |
| Gross heating value | J/L | 40,033 | 40,718 | 41,072 | 39,511 | 38,473 | 41,450 |

TABLE 3-continued

| | Unit | Examples | | | | Comparative Examples | |
|---|---|---|---|---|---|---|---|
| | | 1 | 2 | 3 | 4 | 1 | 2 |
| CCAI | — | 795 | 841 | 864 | 807 | 796 | 890 |
| HFRR (60° C./1000 g) | μm | 348 | 386 | 426 | 375 | 511 | 474 |
| Rubber swelling test | | | | | | | |
| Change in hardness | — | −7 | −17 | −19 | −9 | −8 | −20 |
| Strength change ratio | % | −12 | −39 | −44 | −26 | −21 | −54 |
| Elongation change ratio | % | −12 | −33 | −42 | −24 | −19 | −53 |
| Volume change ratio | % | 8 | 37 | 52 | 16 | 13 | 70 |
| Thickness change ratio | % | 3 | 12 | 17 | 6 | 4 | 21 |

*2: a content of on a sulfur basis the sulfur compound having boiling point of no lower than boiling point of dibenzothiophene

What is claimed is:

1. A C-type heavy fuel oil composition comprising:

a sulfur content of 0.100 mass % or lower, 5 to 400 mass ppm on a sulfur basis of a sulfur compound having a boiling point of no lower than a boiling point of dibenzothiophene, and 25.0 to 70.0 mass % of aromatics, wherein the C-type heavy fuel oil composition has a density (15° C.) of 0.8700 to 0.9400 g/cm$^3$, a kinematic viscosity (50° C.) of 3.500 to 25.000 mm$^2$/s, a pour point of no higher than 25.0° C., a flash point of at least 70.0° C., and a gross heating value of at least 39,000 J/L.

2. The C-type heavy fuel oil composition according to claim 1, comprising 10 vol % or more of an indirect desulfurization residual oil including a sulfur content of 0.100 mass % or less and 0.1 mass % or less of carbon residue, the indirect desulfurization residual oil having a density (15° C.) of 0.8700 to 0.9100 g/cm$^3$, and a kinematic viscosity (50° C.) of 10.000 to 25.000 mm$^2$/s.

3. The C-type heavy fuel oil composition according to claim 2, comprising 5 to 70 vol % of a cracked gas oil including a sulfur content of 0.100 mass % or less, wherein the C-heavy fuel oil composition includes 30 to 95 vol % of the indirect desulfurization residual oil.

* * * * *